US006216466B1

(12) United States Patent
Alkabie

(10) Patent No.: US 6,216,466 B1
(45) Date of Patent: Apr. 17, 2001

(54) FUEL-INJECTION ARRANGEMENT FOR A GAS TURBINE COMBUSTOR

(75) Inventor: Hisham S Alkabie, Sudbrooke (GB)

(73) Assignee: European Gas Turbines Limited (GB)

( * ) Notice: Subject to any disclaimer, the term of this patent is extended or adjusted under 35 U.S.C. 154(b) by 0 days.

(21) Appl. No.: 09/054,869

(22) Filed: Apr. 3, 1998

(30) Foreign Application Priority Data

Apr. 10, 1997 (GB) ..... 9707311

(51) Int. Cl.[7] ..... F02C 7/22; F23R 3/28
(52) U.S. Cl. ..... 60/746; 60/748
(58) Field of Search ..... 60/740, 742, 746, 60/748

(56) References Cited

U.S. PATENT DOCUMENTS 2,618,982 * 11/1952 Nathan ..... 60/742
5,943,866 * 8/1999 Lovett et al. ..... 60/764

FOREIGN PATENT DOCUMENTS 1 215 443 4/1966 (DE) .
0 747 636 A2 12/1996 (EP) .
2 255 628 11/1992 (GB) .

* cited by examiner

*Primary Examiner*—Louis J. Casaregola
(74) *Attorney, Agent, or Firm*—Kirschstein, et al.

(57) ABSTRACT

A fuel-injection arrangement for a gas-turbine engine has distributed longitudinally along a pre-chamber portion of the combustion chamber a series of fuel-outlet holes configured such that a radial component of momentum of the fuel exiting the holes varies along the series of holes. To achieve this the holes are preferably differently sized along the trailing edge. Advantageously, the holes at the very upstream end of the pre-chamber portion have the smallest diameter, the size thereafter progressively increasing along the series. The size distribution may vary either continuously, or in stepped fashion. The direction of exit of the fuel from the outlets is preferably radial towards the central axis of the swirler. The variable-sized holes may be employed in a swirler upstream the main combustion chamber region and/or in an intermediate region between the swirler and the main chamber region.

17 Claims, 4 Drawing Sheets

FUEL-INJECTION ARRANGEMENT FOR A GAS TURBINE COMBUSTOR

BACKGROUND OF THE INVENTION

The invention concerns a fuel-injection arrangement for a combustor of a gasturbine engine, and in particular a fuel-injection arrangement enabling reliable performance at low load conditions of said engine.

Provision is made in gas turbine engines to inject fuel into a region upstream of the main combustor region of the engine for mixing with air and eventual burning in the main combustor region.

FIG. 1 shows part of a gas-turbine engine comprising a combustion chamber 10, a fuel-inlet head 12 and a radial swirler 14 disposed therebetween. The swirler 14, which is commonly used in gas turbine engines as a mixing device to mix fuel and air for supply to the combustion chamber, is configured as illustrated in FIGS. 2*a* and 2*b* and comprises a series of vanes 16 equally spaced around a circumference of the swirler, the vanes forming a corresponding series of passageways 18 for the flow of mixing air 20 through the swirler from a radially outer to a radially inner region thereof.

The vanes are shaped and disposed such as to impart to the incoming air a tangential component, whereby the air is caused to "swirl" around the longitudinal axis 22 of the swirler, the air also being caused to exit the swirler at a downstream region thereof and enter the combustion chamber 10 (see arrows 21).

Along the trailing-edge region 24 of the vanes 16—i.e. trailing-edge in terms of air flow through the vane arrangement—are conventionally disposed a series of fuel outlets 26 fed from a fuel inlet conduit 28 connected to the fuel head 12. The outlets or holes 26 are of uniform diameter and are evenly spaced axially along the trailing edge. Use of such holes evenly spaced along at least most of the length of the trailing edge promotes better mixing of fuel and air by making for a uniform distribution of the fuel along the axial length of the swirler.

SUMMARY OF THE INVENTION

In accordance with the present invention, there is provided a fuel injection arrangement for a gas turbine combustor, comprising at least one series of fuel-injection outlets arranged in spaced-apart relationship, referred to a longitudinal axis of said combustor, in a pre-chamber region of said combustor upstream of a main-chamber region thereof, said series of outlets being such as to provide, in use, a longitudinal variation in a radial component of momentum of fuel jets exiting said outlets. The variation in radial component of momentum preferably takes the form of a variation in a radial component of velocity, which may achieved by arranging for the outlets in the series to be of varying size.

The outlets may be smallest in an axially upstream portion of said pre-chamber region and the variation in outlet size in said series may be monotonic referred to said longitudinal axis.

Said variation may be a continuous variation or alternatively a stepped variation. It may be linear over at least a part of said series of outlets.

The outlets, which may be substantially equally spaced, may be configured such that a direction of fuel jets exiting said outlets is substantially radial.

The outlets may be disposed in a swirler portion of said pre-chamber region, and/or they may be disposed in an intermediate portion of said pre-chamber region between a swirler portion thereof and said main-chamber region. In the former case, where said swirler portion comprises a plurality of vanes, said series of outlets may be incorporated into each of at least some of said vanes at a trailing edge thereof. In the latter case, the outlets may be disposed in a wall of said intermediate portion. Alternatively, the outlets may be provided in fuel posts situated in said pre-chamber region.

BRIEF DESCRIPTION OF THE DRAWINGS

An embodiment of the invention will now be described, by way of example only, with reference to the drawings, of which.

DETAILED DESCRIPTION OF EMBODIMENTS OF THE INVENTION

Figure 3:
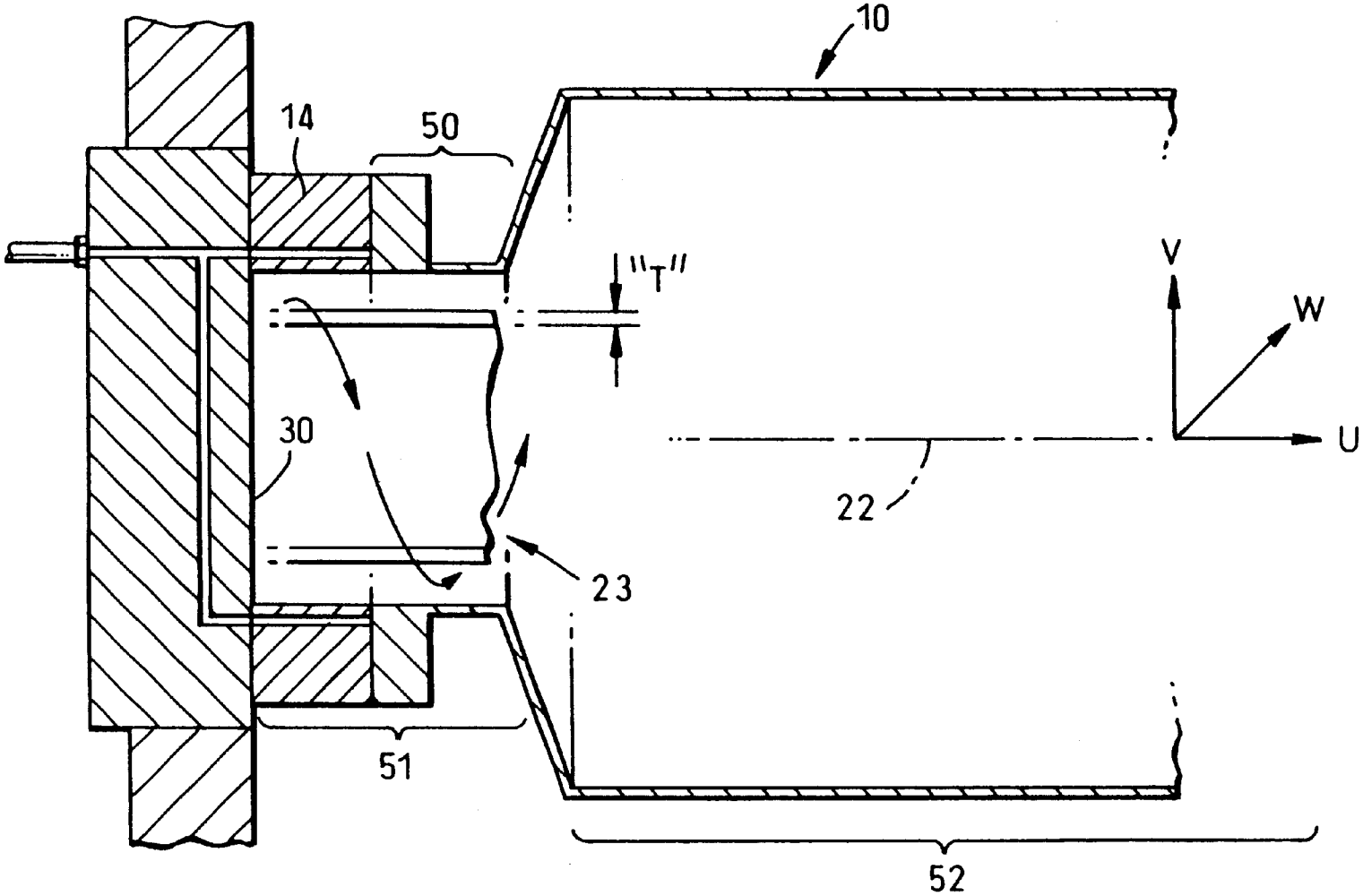
FIG. 3 is a view of a gas-turbine engine corresponding to that of FIG. 1 and showing a dynamic aspect of the fuel-air mixture inside the swirler according to the prior art.

The operation of the swirler according to the invention is now explained with reference to FIG. 3. In FIG. 3, which shows the same engine arrangement as in FIG. 1 and includes a prior-art swirler, it can be seen that, in operation, in a radially central region of the swirler 14 there is a body of fuel and air 23 rotating around the swirler axis 22 moving in a direction away from the swirler and toward the combustion chamber 10. This rotating body can be likened to a spinning tube with an effective tube wall consisting of an air/fuel mixture and having a thickness "T" and turning in corkscrew fashion. In this central region of the swirler three airflow velocity components can be identified: an axial component (U) pointing in a direction parallel to the swirler axis 22, a radial component (V) normal to the swirler axis 22, and a tangential component (W) about the swirler axis 22.

Figure 1:
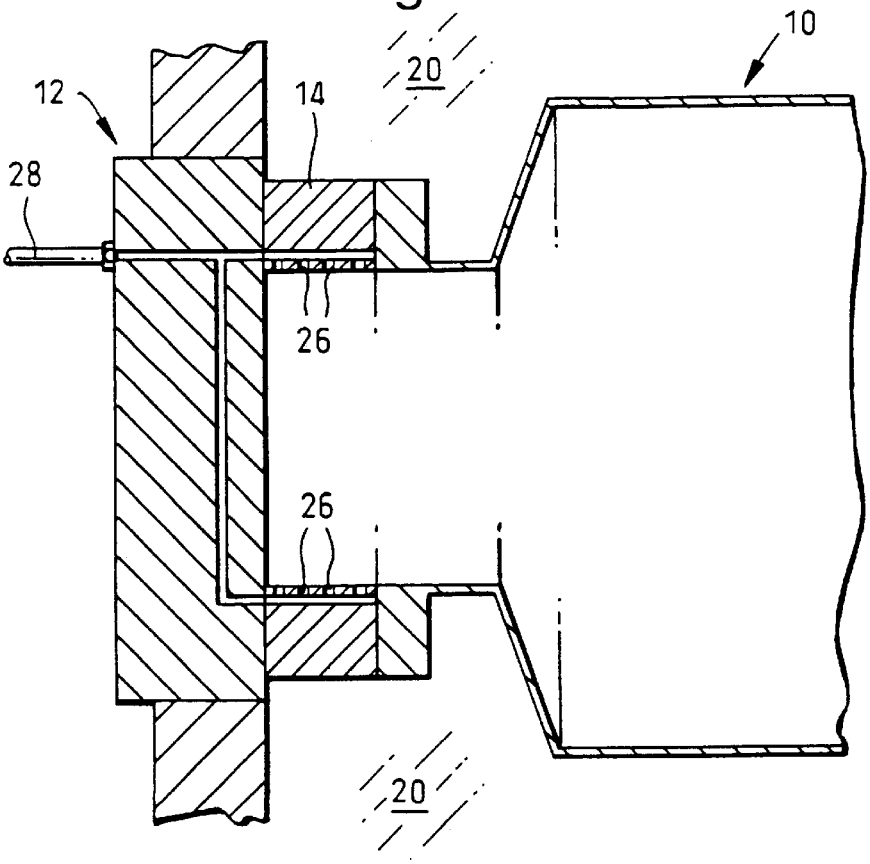
FIG. 1 is a sectional view of part of a gas-turbine engine incorporating a conventional swirler according to the prior art.
Figure 2:
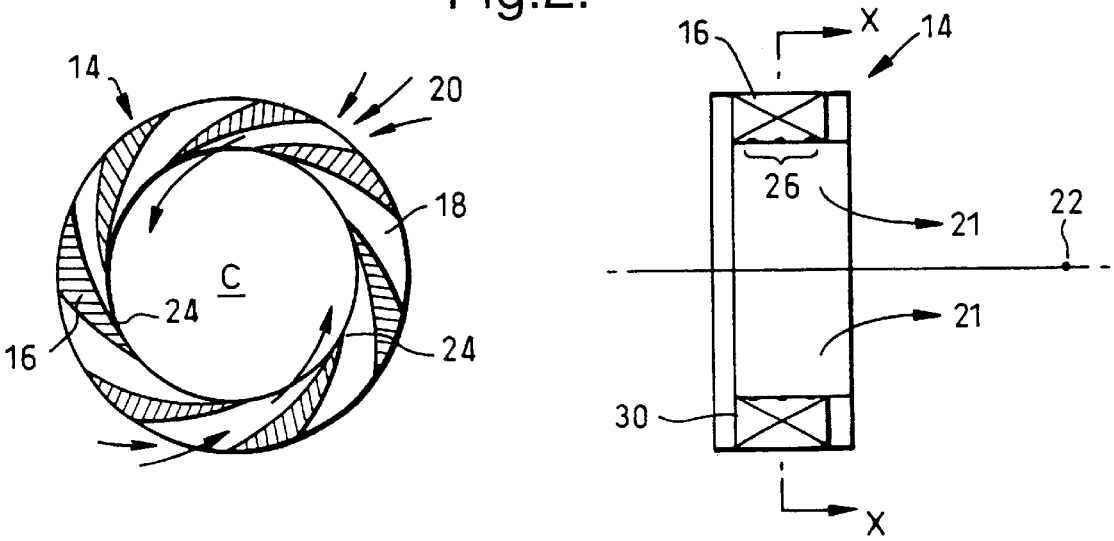
FIGS. 2*a* and 2*b* shows the swirler of FIG. 1 in both side- and end-elevations according to the prior art.

In a gas turbine combustor of the type shown in FIGS. 1 and 3, the combustion flame has an upstream flame face in the region of the swirler back-face 30 and a downstream flame face in or towards the combustion chamber facing the swirler. As engine load decreases and with less fuel supplied, the downstream flame face withdraws progressively to the upstream face so that at minimum operating load (or on engine starting) there exists only a small pilot flame which is located in the swirler region. Typically, the upstream flame-face zone is a fuel-weak region and without some means of fuel supplementation to this region the pilot flame would tend to extinguish at low-load settings. This is because in a fuel-weak mixture the flame spreads to find fuel and in so doing is weakened, to the point at which extinction of the flame occurs—so-called "weak extinction". One reason for the region being fuel-weak is that the aforementioned tube wall acts as a barrier to the incoming fuel-air mixture from the swirler. Furthermore, inside the so-called tube is a counter-flowing mass of partly burnt (and therefore fuel-weak) combustion gases drawn from the combustion chamber.

One known way of supplementing the provision of fuel to the pilot flame under these circumstances is to inject fuel directly into the region from a fuel injector means situated at the back-face of the swirler. Such a method is generally effective in sustaining a flame at low-load settings, but has the drawback of adding to the overall constructional complexity of the combustor assembly.

The present invention provides a swirler which enhances the radial momentum of the fuel jets leaving the fuel outlets in the afore-mentioned fuel-weak region at the upstream end of the swirler. This has the effect of enabling the fuel jets at that part of the swirler to penetrate through the "tube" wall, thereby to supplement the fuel supply to the pilot flame within the "tube", thus maintaining the stability of the flame at low load settings without the need for supplementary fuel provision.

Figure 4A:
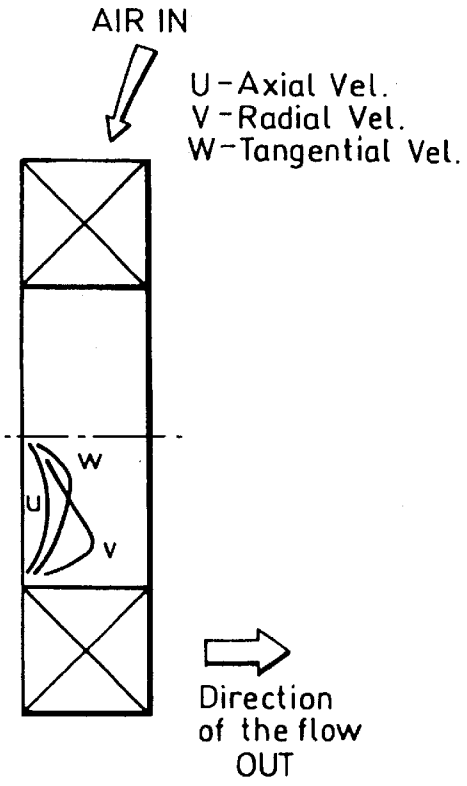
FIGS. 4(*a*), 4(*b*) and 4(*c*) are side views of the swirler showing a velocity profile for the fuel-air mixture at upstream-end, two-thirds from upstream-end and downstream-end axial points, respectively, of the swirler.
Figure 4B:
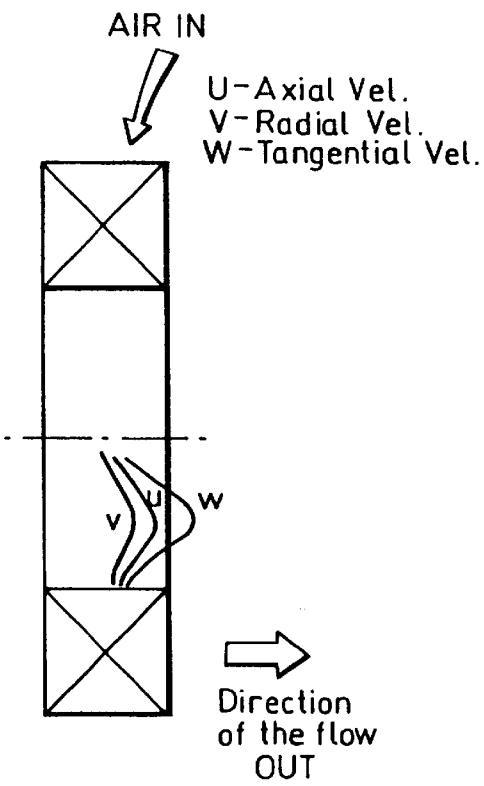
Figure 4C:
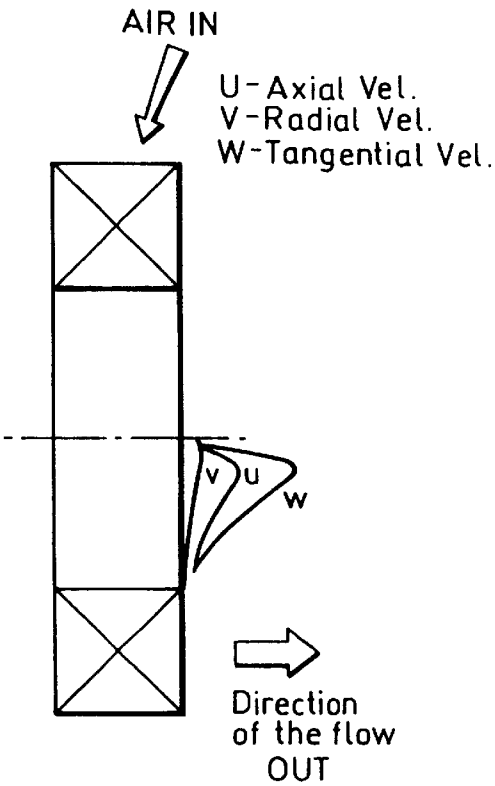

The preferred way of increasing radial momentum according to the invention is to increase the radial velocity of the fuel jets- This enhancement of radial-velocity component reinforces an existing velocity characteristic of the swirler which can be seen by reference to FIG. 4. In FIG. 4(*a*) a typical profile graph of velocity components as a function of radial distance from the swirler axis for the fuel-air mixture exiting the swirler at an axial position adjacent the swirler back-face 30 is shown. It can be seen that the radial component is the largest component at this point and the axial component the weakest. By contrast, at the downstream face of the swirler (see FIG. 4(*c*)) the radial velocity component is the weakest and the tangential component is the strongest. At an intermediate position, e.g. two-thirds of the way from the upstream end-face 30 (FIG. 4(*b*)), the tangential component is already well established and the radial component is not significantly greater than in the downstream-end case shown in FIG. 4(*c*).

For the jets of fuel nearest the pilot flame to actually reach the flame, they must penetrate through the "tube" wall and must therefore have sufficient radial momentum. It is of benefit that the radial velocity of the airflow is already greatest in this area, but it is not strong enough by itself to carry fuel through to the flame. Even when the additional radial momentum given by the fuel jets is taken into account, there is not sufficient energy to breach the wall if the conventional swirler design is used.

The invention takes the step of sizing the holes nearest the upstream end 30 smaller than those in the mid- and end-region, which increases the velocity of the fueljet passing through those holes. This increase in velocity produces a corresponding increase in the momentum flux ratio, which is defined as:

$$\text{Momentum flux ratio}=\rho_F V_F^2 \rho_A V_A^2$$

where $\rho_F$ is fuel density $V_F$ is fuel velocity $\rho_A$ is air-wall density $V_A$ is air-wall velocity.

The fuel-jet holes are reduced to a size giving a value of $V_F$ sufficient to yield a momentum flux ratio of greater than unity, which will then ensure penetration of the fuel through the wall. The hole size required varies according to wall density and will therefore be different for each engine combustor configuration. The hole size may be obtained by application of the following formula:

$$d_F=k\ y_{max}.\ (\text{Momentum flux ratio})^{1/2}$$

where $d_F$ is the diameter of the fuel jet, $y_{max}$ is maximum fuel-jet penetration required, and k is a constant.

The constant k is arrived at empirically by making incremental adjustments to an actual system, and for a typical system might lie in the region of 1.25.

Figure 5B:
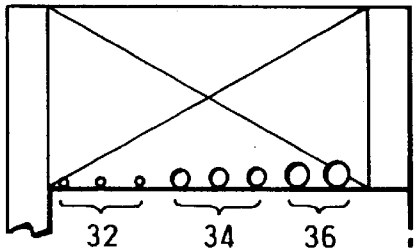
FIGS. 5(*a*) and 5(*b*) show two alternative fuel-outlet size distribution profiles for he swirler of the present invention.
Figure 5A:
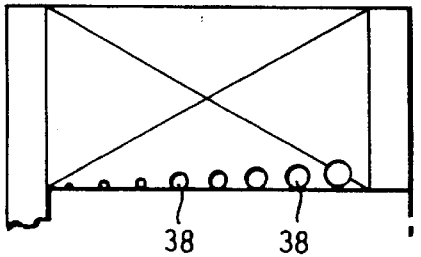

The size of the holes varies progressively over the length of the trailing edge of the vane, the distribution being either continuous, i.e. each hole along the edge being larger than the previous one, or stepped, i.e. hole size varies in discrete jumps. These two cases are illustrated in FIGS. 5(*a*) and 5(*b*), respectively. In the case of FIG. 5(*b*) three small holes 32 are shown on the lefthand side of the diagram, likewise three holes 34 of an intermediate size, and finally two large holes 36. By contrast, in FIG. 5(*a*) all holes 38 are of different diameters. It goes without saying that these representations are exemplary only, and the numbers of holes and their distribution will vary considerably in practice and depending on the application.

Figure 6:
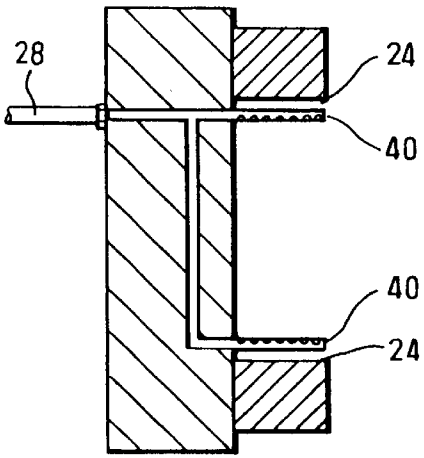
FIG. 6 shows an embodiment of the swirler according to the invention in which fuel is supplied to the swirler by way of fuel posts.

Whereas it has been assumed in the description of the invention so far that fuel will be introduced into the vanes themselves, so that the fuel outlets are holes formed in the vanes, it is also possible to employ fuel posts to carry the fuel into the swirler. Such a scheme is shown very schematically in FIG. 6, where two posts 40 connected to the inlet conduit 28 extend into the swirler in the area just inside the trailing edge 24 of the vanes. Holes are formed in these posts as they were in the vane-fed scheme shown, for example, in FIG. 5, and the dimensions of the holes are, as already explained, different over the length of the post.

Figure 7:
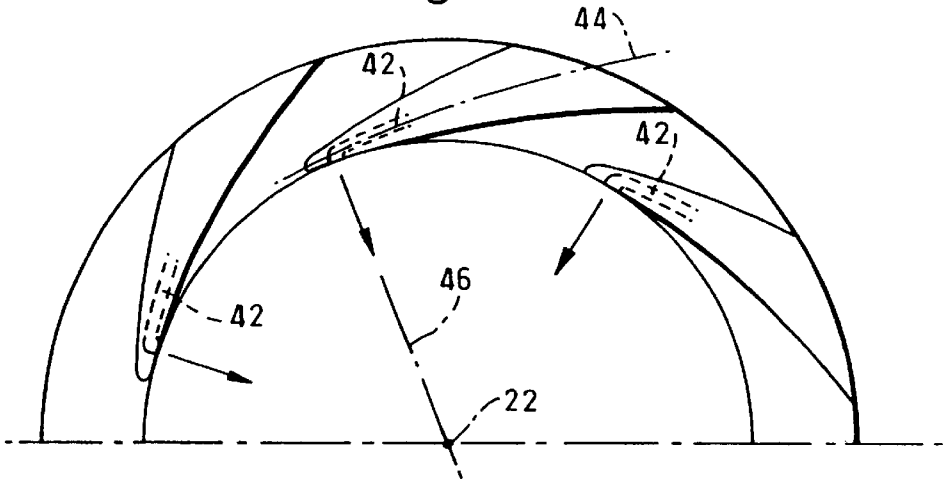
FIG. 7 is an end-view of the swirler according to the invention including radially oriented fuel outlets.

It is preferable to arrange the fuel outlets so that the fuel passing through them is aimed as near as possible towards the central axis 22 of the swirler in order to maximize the radial component of velocity of the fuel. An example of such an arrangement is shown in FIG. 7, in which each vane is fed with fuel along a conduit 42 lying roughly parallel to a median, approximately tangential, axis 44 of the vane, the conduit 42 then changing direction by approximately 90° to lie roughly in a radial direction 46 oriented towards the axis 22 of the swirler. The line of exit of the fuel may, however, in practice lie anywhere between the median line 44 and the radial line 46.

The fuel outlets may be allocated to each vane of the swirler, or alternatively may be restricted to some vanes only, e.g. every other vane.

Although the invention has been described in connection with its implementation in a swirler, it is also possible to incorporate the variable hole-sizing technique in the combustor pre-chamber wall region shown as 50 in FIG. 3, where there may still be an effective rotating body of fuel-air mixture having a wall thickness T nearby. The whole pre-chamber region 51 thus comprises both the swirler region 14 and the afore-mentioned region 50 intermediate the swirler and the main-chamber portion 52 of the combustion chamber 10.

Figure 8:
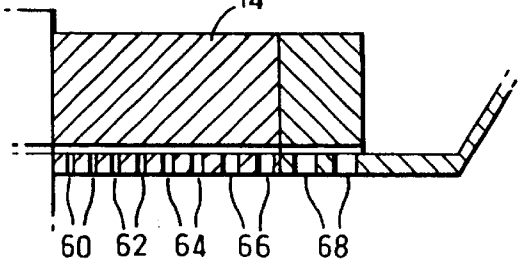
FIG. 8 is a partial view of FIG. 3 showing the use of the variable-sized outlets according to the invention in an intermediate portion of a pre-chamber region of the combustion chamber.

The present inventive fuel-injection technique may be incorporated into either the swirler, or the intermediate chamber area 50, or both. FIG. 8 shows stepped holes 60, 2, 64, 66, 68 in both areas. The use of fuel posts to supply the fuel applies equally to the swirler portion 14 and to the intermediate portion 50 and, where the present inventive fuel-injection technique is employed in both portions, an extended length of post can be used in simple manner. Where, alternatively, the variable-sized fuel outlets are incorporated into the wall of the intermediate portion 50 rather than in adjacent fuel posts, fuel may be supplied to those outlets either from an extension of the fuel-gallery system supplying the swirler outlets, or from some additional system, whichever is convenient.

Where the invention is applied to the intermediate portion 50 only, mixing of fuel and air upstream of the intermediate portion may be by means of a swirler or by any other appropriate method.

I claim:

1. A fuel injection arrangement for a gas turbine combustor having a longitudinal axis extending in a streamwise direction with respect to combustion flow therethrough, a main combustion chamber region, and a pre-chamber region upstream of and arranged coaxially with the main chamber region, the fuel injection arrangement comprising: at least one series of fuel injection outlets arranged peripherally of the pre-chamber region in an axially spaced-apart relationship as considered along the longitudinal axis, and positioned for discharging fuel into the pre-chamber region, each of the outlets being operative for discharging fuel as a jet having a momentum in a radially inwards direction generally perpendicular to the longitudinal axis, the momentum varying over the outlets along the longitudinal axis.

2. The arrangement according to claim 1, wherein said momentum varies due to a variation of radial jet velocity over said at least one series of fuel injection outlets.

3. The arrangement according to claim 2, wherein the outlets in said at least one series of fuel injection outlets are of varying size.

4. The arrangement according to claim 3, wherein the outlets have a variation in outlet size which is smallest in an axially upstream portion of the pre-chamber region.

5. The arrangement according to claim 4, wherein the variation in outlet size in said series is monotonic along the longitudinal axis.

6. The arrangement according to claim 5, wherein the variation in outlet size is continuous.

7. The arrangement according to claim 5, wherein the variation in outlet size is stepped.

8. The arrangement according to claim 5, wherein the variation in outlet size is linear over at least a part of said series of outlets.

9. The arrangement according to claim 1, wherein the outlets are configured such that the fuel jets exit the outlets substantially along the radially inwards direction.

10. The arrangement according to claim 1, wherein the outlets are substantially equally spaced apart along the longitudinal axis.

11. The arrangement according to claim 1, wherein the outlets are disposed in an intermediate portion of the pre-chamber region between a swirler portion thereof and the main chamber region.

12. A fuel injection arrangement for a gas turbine combustor having a longitudinal axis extending in a streamwise direction with respect to combustion flow therethrough, a main combustion chamber region, and a pre-chamber region upstream of the main chamber region, the fuel injection arrangement comprising: at least one series of fuel injection outlets arranged in the pre-chamber region and disposed in a swirler portion thereof in an axially spaced-apart relationship as considered along the longitudinal axis, and positioned for discharging fuel directly into the pre-chamber region, each of the outlets being operative for discharging fuel as a jet having a radial momentum as considered along a radial direction generally perpendicular to the longitudinal axis, the radial momentum varying over the outlets along the longitudinal axis.

13. The arrangement according to claim 11, wherein the outlets are disposed in a wall of the intermediate portion.

14. The arrangement according to claim 1, wherein the outlets are provided in fuel posts situated in the pre-chamber region.

15. A fuel injection arrangement for a gas turbine combustor having a longitudinal axis extending in a streamwise direction with respect to combustion flow therethrough, a main combustion chamber region, a pre-chamber region upstream of the main chamber region, and a swirler portion in the pre-chamber region, the swirler portion having a plurality of vanes, the fuel injection arrangement comprising: at least one series of fuel injection outlets arranged in the prechamber region in an axially spaced-apart relationship as considered along the longitudinal axis, and operative for discharging fuel with a variation along the longitudinal axis in a radial component of momentum of fuel jets exiting the outlets, the radial component extending along a radial direction generally perpendicular to the longitudinal axis, the outlets being disposed in the swirler portion of the pre-chamber region, the at least one series of outlets being incorporated into each of at least some of the vanes at a trailing edge thereof.

16. The arrangement according to claim 12, wherein the swirler portion comprises a plurality of vanes, said at least one series of outlets being incorporated into each of at least some of the vanes at a trailing edge thereof.

17. A fuel injection arrangement for a gas turbine combustor having a longitudinal axis extending in a streamwise direction with respect to combustion flow therethrough, a main combustion chamber region, a pre-chamber region upstream of and arranged coaxially with the main chamber region, and a radial swirler arranged peripherally of the pre-chamber region and operative to impart radially inward swirling motion to combustion air entering the pre-chamber region, the swirling motion being about the longitudinal axis, the fuel injection arrangement comprising: at least one series of fuel-injection outlets arranged in the pre-chamber region in an axially spaced-apart relationship as considered along the longitudinal axis and positioned for discharging fuel into the pre-chamber region, each of the outlets being operative for discharging fuel as a jet having a radial momentum as considered along a radial direction generally perpendicular to the longitudinal axis, the radial momentum varying over the outlets along the longitudinal axis.

* * * * *